US005687496A

United States Patent [19]

McEnroe

[11] Patent Number: 5,687,496

[45] Date of Patent: Nov. 18, 1997

[54] NOTE-HOLDING ACCESSORY FOR A SAFETY HELMET

[76] Inventor: Oliver McEnroe, 155 Fulton Ave., Toronto, Ontario, Canada, M4K 1Y2

[21] Appl. No.: 431,747

[22] Filed: May 1, 1995

[51] Int. Cl.[6] ..... A42B 1/24

[52] U.S. Cl. ..... 40/329; 40/661; 229/67.2

[58] Field of Search ..... 40/329, 642, 661, 40/159; 229/67.2; 2/416, 418, 421

[56] References Cited

U.S. PATENT DOCUMENTS 2,665,422 1/1954 Green et al. ..... 2/416

3,906,548 9/1975 Kallis ..... 2/416 X

*Primary Examiner*—Anthony Knight

*Assistant Examiner*—Cassandra Davis

*Attorney, Agent, or Firm*—Mirek A. Waraksa

[57] ABSTRACT

A flexible planar note holder stores information such a names and telephone numbers within a safety helmet that has a rigid outer shell and an inner harness with straps. The holder has a pocket, an opening accessing the pocket, a transparent face that permits viewing into the pocket, and a pair of T-slots at opposing ends of the holder, each slot dimensioned to locate about any strap of the harness. A paper card that carries the information is inserted into the pocket. The two T-slots are located about opposing straps to keep the holder positioned against the harness with the transparent face and information facing downward toward the open bottom of the helmet. When the wearer removes the helmet, the information is immediately available.

4 Claims, 2 Drawing Sheets

NOTE-HOLDING ACCESSORY FOR A SAFETY HELMET

FIELD OF THE INVENTION

The invention relates to methods and accessories that permit individuals at construction sites and comparable work environments to conveniently store and retrieve information such as names and telephone numbers.

BACKGROUND OF THE INVENTION

A foreman on a construction site often needs telephone numbers for various suppliers, contractors and inspectors. Briefcases and electronic organizers are not particularly appropriate for the rigors of a construction site. Foremen often carry telephone numbers and other information on loose scraps of paper, tucked into various pockets, and the information is very readily lost. The invention addresses this problem.

BRIEF SUMMARY OF THE INVENTION

In one aspect, the invention provides a method of storing and retrieving information that is particularly suited for individuals who work at construction sites and other hazardous work environments. The invention takes advantage of the fact that such individuals are normally required to wear safety helmets. Such helmets commonly comprise a rigid outer shell and inner domed harness with straps. The method comprises inscribing the information onto a sheet, preferably a fairly rigid paper card. The sheet is inserted into a pocket defined by a thin flexible holder dimensioned to fit within the harness and having a transparent face that permits viewing of the information. The holder is attached to a harness strap to keep the holder within the helmet. The wearer can simply remove the helmet to quickly find the information he needs.

In another aspect, the invention provides an accessory for storing information within a safety helmet. The accessory comprises a flexible planar holder dimensioned to fit against a harness within the safety helmet. The holder defines a pocket that retains a sheet on which the information may be inscribed, an opening accessing the pocket to permit insertion and removal of the sheet, a transparent face that permits viewing into the pocket, and a pair of fasteners at opposing ends of the holder for securing to straps of the harness. The holder can be more conveniently and unobtrusively retained against the harness, immediately above the wearer's head, and does not protrude from the helmet each time the wearer removes the helmet. Also, with a pair of fasteners at opposing ends, the holder can be oriented so that the transparent face and information on the sheet face toward the open bottom of the helmet and the information can be thus be viewed immediately upon removing the helmet. Each fastener is preferably a T-slot dimensioned to locate about any one of the straps.

Various aspects of the invention will be apparent from a description below of a preferred embodiment of a holder and will be more specifically defined in the appended claims.

DESCRIPTION OF THE DRAWINGS

The invention will be better understood with reference to drawings in which.

DESCRIPTION OF PREFERRED EMBODIMENTS

Figure 1:
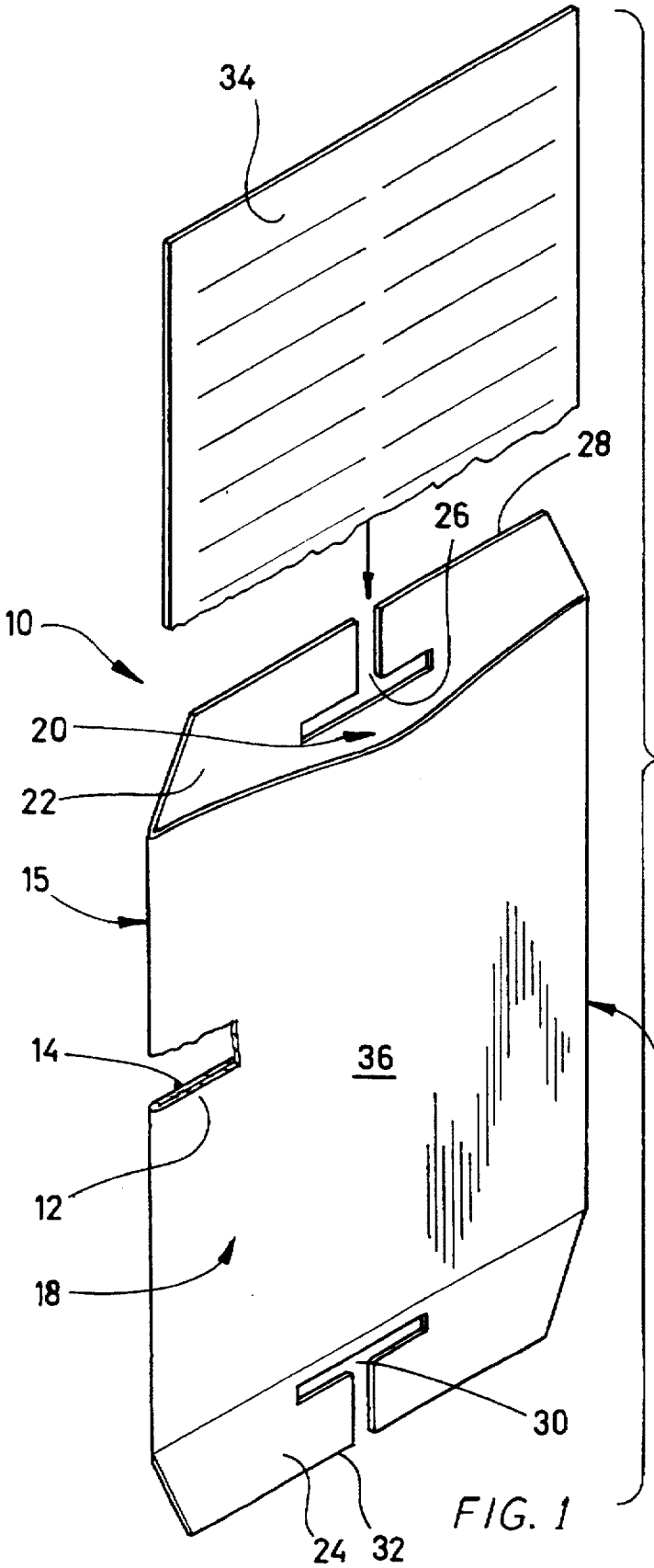
FIG. 1 is a fragmented perspective view showing a note holder.

Reference is made to FIG. 1 which shows a note holder 10. The note holder 10 is a flexible planar structure formed of thin plastic. It comprises forward and rear panels 12, 14 which are joined along their lateral side edges 15, 16 (numbered only in FIG. 1) and adjacent to the bottom of the holder 10 to define a pocket 18. The interior of the pocket 18 is accessed by an opening 20 (numbered only in FIG. 1) at an upper end 28 of the holder 10. The rear panel 14 has opposing upper and lower tabs 22, 24. The upper tab 22 has a T-slot 26 which opens into an upper end 28 of the holder 10. The lower tab 24 has another T-slot 30 which opens into the lower end 32 of the holder 10. A card 34 is provided on which the user can write, for example, names and telephone numbers. The paper card 34 is dimensioned for insertion into and removal from the pocket 18 through the upper opening 20. The holder 10 is formed of a transparent plastic so that the forward panel 12 presents a face 36 through which information inscribed on the card 34 can be viewed.

Figure 3:
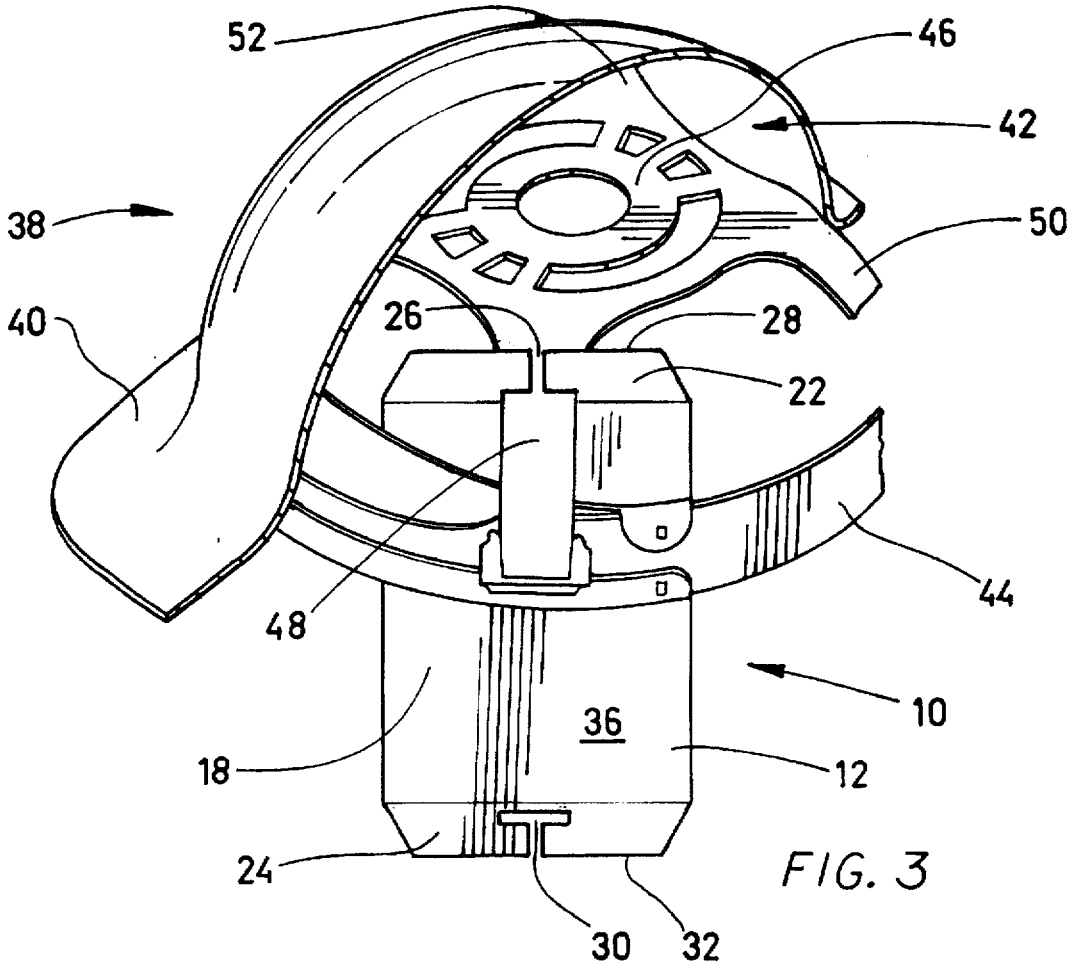
FIG. 3 is a fragmented perspective view showing the note holder partially fixed to the harness of the helmet; and, FIG. 4 is a plan view from below of the interior of the helmet showing the note holder retained between two straps of the harness.
Figure 4:
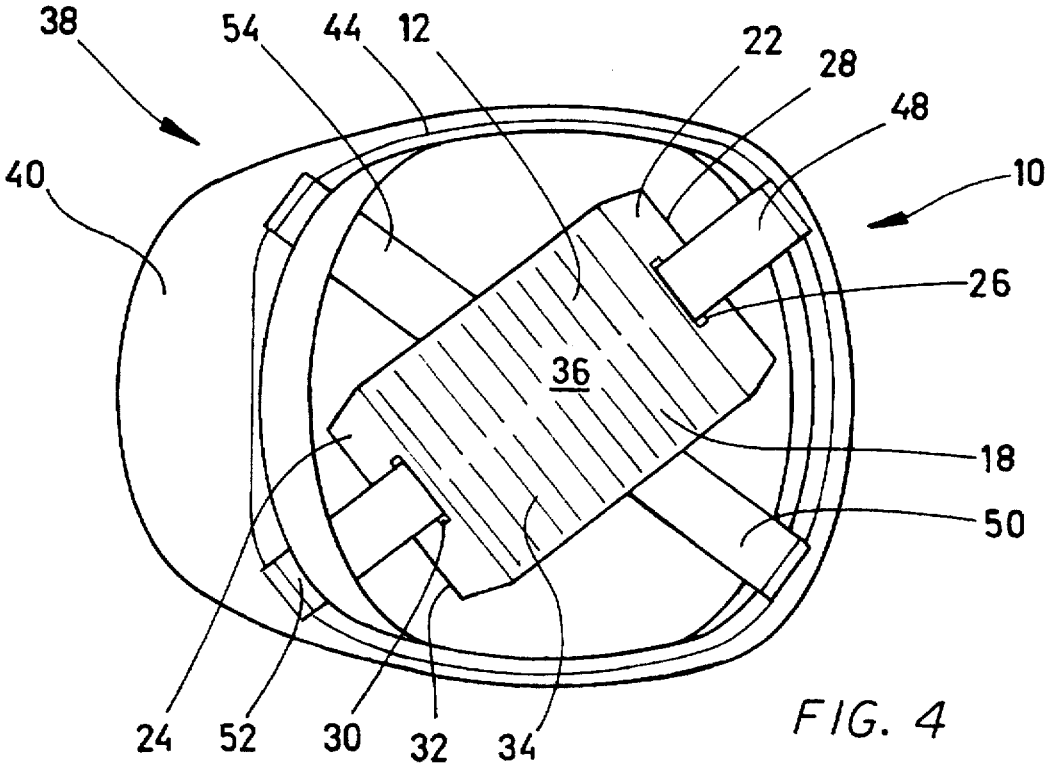

FIGS. 3 and 4 show the holder 10 installed in a conventional safety helmet 38. The helmet 38 comprises a rigid shell 40 and an internal harness 42 which spaces the shell 40 from the wearer's head. The harness 42 comprises an adjustable band 44 which locates about the forehead, back and sides of the wearer's head and which is normally fixed to the outer shell 40. The harness 42 comprises a central section 46 that normally bears against the top of the wearer's head and several radial straps 48, 50, 52, 54 that join the central section 46 to the band 44.

Figure 2:
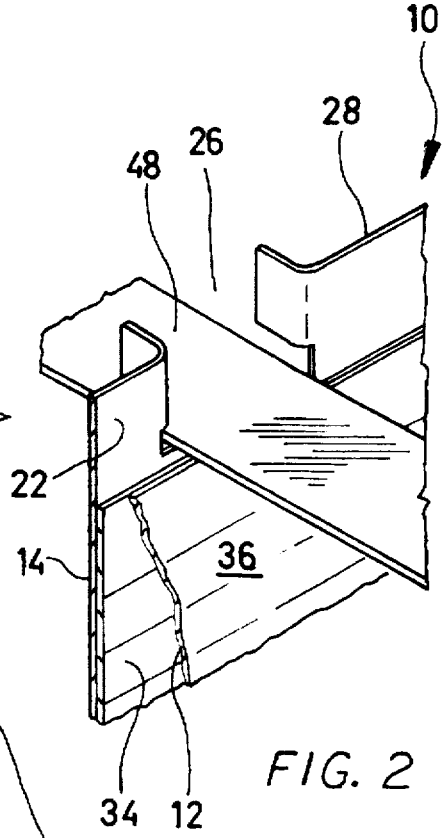
FIG. 2 is another fragmented perspective view showing how the holder mounts about a strap which is part of a harness within a safety helmet.

The T-slots 26, 30 are shaped and dimensioned to receive any one of the straps 48–54. The upper T-slot 26 is shown in FIG. 3 fitted about the strap 48. To locate the upper T-slot 26 about the strap 48, sections of the upper tab 22 are deflected as shown in FIG. 2 to receive the strap 48 and then restored to a rest position in the plane of the holder 10. The lower T-slot 30 may be similarly fitted as shown in FIG. 4 about an opposing strap 52. This preferred method of securing the note holder 10 to the harness 42 is particularly convenient. First, the note holder 10 is held positively against the harness 42, making it less obtrusive for normal wearing and removal of the hat. Second, the transparent face 36 and the information on the card 34 face towards the open bottom of the helmet 38. Thus, upon removing the helmet 38, the holder 10 is oriented as shown in FIG. 4 so that any information on the card 34 is immediately available.

It will be appreciated that a particular embodiment of the invention has been described and that modifications may be made therein without departing from the spirit of the invention or necessarily departing from the scope of the appended claims.

I claim:

1. A method of storing information that permits quick retrieval of the information by a wearer of a safety helmet, the helmet comprising a rigid outer shall shell and a domed inner harness with straps, the method comprising:

inscribing the information onto a sheet;

inserting the sheet into a pocket defined by a flexible planar holder that is dimensioned to fit against the harness and has a transparent face permitting viewing of the information on the sheet; and, attaching the holder to one strap of the harness and to another strap of the harness such that the holder is held against the harness with the transparent face facing downward toward an open bottom of the helmet whereby, the wearer can retrieve the information by removing the helmet from his head.

2. The method of claim 1 which the holder comprises a pair of T-slots, each of the slots is formed at a different one of a pair of opposing ends of the holder and each of the slots is shaped and dimensioned for location about any one of the straps of the helmet, and the attaching of the holder to the harness comprises locating one of the T-slots about the one strap of the harness and locating the other of the T-slots about the other strap of the harness.

3. A safety helmet adapted to store information for quick retrieval by a wearer, the safety helmet having a rigid outer shell and an domed inner harness with a plurality of straps, the safety helmet comprising:

a flexible planar holder located within the harness, the holder comprising a pocket, an opening accessing the pocket, a T-slot located about one of the plurality of straps thereby securing the holder to the harness, and a transparent face that permits viewing into the pocket; and, a sheet on which the information can be inscribed, the sheet being located within the pocket and dimensioned for insertion and removal through the opening.

4. The safety helmet of claim 3 in which the holder comprises:

a pair of flexible plastic sheets overlaid and joined along their edges to define the pocket, one of the pair of flexible plastic sheets defining the transparent face; and, a pair of tabs attached to opposing ends of the pocket, one of the pair of tabs defining the T-slot and the other of the pair of tabs defining another T-slot located about another of the plurality of straps.

* * * * *